US008191747B2

(12) United States Patent
Pruchnicki

(10) Patent No.: US 8,191,747 B2
(45) Date of Patent: Jun. 5, 2012

(54) INSULATED CONTAINER WITH ASYMMETRIC LIFTING ARRANGEMENT

(75) Inventor: Renia Pruchnicki, Toronto (CA)

(73) Assignee: California Innovations Inc. (CA)

( * ) Notice: Subject to any disclaimer, the term of this patent is extended or adjusted under 35 U.S.C. 154(b) by 919 days.

(21) Appl. No.: 12/131,646

(22) Filed: Jun. 2, 2008

(65) Prior Publication Data

US 2009/0294455 A1 Dec. 3, 2009

(51) Int. Cl.
*A45F 3/02* (2006.01)

(52) U.S. Cl. ..... 224/612; 224/614; 224/622

(58) Field of Classification Search ..... 224/600–622, 224/580, 257, 258, 264, 158, 159, 625; 383/6; 150/107, 108; D3/327; D7/607; *A45F 3/02*
See application file for complete search history.

(56) References Cited

U.S. PATENT DOCUMENTS 5,806,733 A * 9/1998 Smith ..... 224/264
5,892,202 A * 4/1999 Baldwin et al. ..... 219/387
6,116,045 A * 9/2000 Hodosh et al. ..... 62/457.4
6,247,328 B1 * 6/2001 Mogil ..... 62/457.2
7,669,743 B2 * 3/2010 Bruton ..... 224/159

FOREIGN PATENT DOCUMENTS

FR 2869513 A1 * 11/2005

* cited by examiner

*Primary Examiner* — Justin Larson
(74) *Attorney, Agent, or Firm* — Ostrolenk Faber LLP

(57) ABSTRACT

A soft-sided insulated container assembly includes a collapsible cooler body made of insulated panels. The body is to be carried by an arrangement of lifting apparatus that includes asymmetrically arranged fittings. One lifting fitting may be an inboard shoulder strap. Another fitting may an handle located on an outboard portion of face of the container body, and may be at a height for engagement by the hand of the user. The soft-sided insulated container assembly may have a liner to contain liquids. The soft-sided insulated container assembly may have an easy access lid. The insulated container may be collapsed to a flat position, and secured in place. In one embodiment the asymmetric lifting arrangement includes a shoulder strap attached to the sides of the container in a manner that distributes the load into the sides of the container, and a grip, such as a handle, located on the lower portion of the front side of the container. The grip may be attached to the container so as to pull up on the bottom of the container when used by a person.

13 Claims, 16 Drawing Sheets

INSULATED CONTAINER WITH ASYMMETRIC LIFTING ARRANGEMENT

FIELD OF THE INVENTION

This invention relates to the field of portable soft-sided insulated containers.

BACKGROUND OF THE INVENTION

Soft sided insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer, soft drinks, or other carbonated beverages, juices and milk. Or ice cream snacks or frozen flavoured refreshments. Sometimes these containers may be used to carry lunches, which may include a sandwich, fruit, carrot and celery sticks, a drink, cookies, and so on.

Typically, the container may be slung over one shoulder, and carried to the side of the body. For example, it may be used by a vendor at a sporting event. Articles carried in a container of this nature can be quite heavy, and perhaps somewhat awkward. The use of such a container can put a strain on the carrier's back, arms and shoulders. For example, may of the containers of this nature are designed to carry between six and thirty (or more) 355 ml soft drink cans of about 2½" dia.×4⅞" high. The container may also have a tendency to swing, or rotate, about the carrier's hips. This may not necessarily be comfortable or convenient.

SUMMARY OF THE INVENTION

In an aspect of the invention there is a soft-sided insulated container assembly. It has a container body having length, height and depth, a primary lifting member, and a secondary grip. The container body has a centroid relative to the length, height, and lateral depth. The length is at least as great as the lateral depth. The container body has a soft-sided wall structure that includes an outer skin, an inner skin and a layer of insulation therebetween. The container body has an insulated chamber defined therewithin, and has an externally accessible closure member governing access thereto. The primary lifting member has first and second attachments longitudinally bracketing the centroid. The primary lifting member has a lifting member lying inboard of the container body relative to the depth thereof. The lifting member is, in use, at an height higher than the body. The grip is located longitudinally intermediate the first and second attachments of the primary lifting member. The grip is located outboard of the container body relative to the lateral depth thereof. The grip is located at a height lower than the centroid.

In an additional feature of that aspect of the invention, the container has a pair of longitudinally spaced apart end walls and the primary lifting member includes portions distributing vertical load into the end walls. In another feature, the grip includes a handle standing outwardly from a face of the container body. In another feature the container has a base panel and sidewall panels extending peripherally upwardly therefrom the grip is rooted to pull upwardly on the base panel. In another feature the body has an uppermost panel, the panel includes the closure member, and the closure member has a hinged laterally inboard edge. In another feature the uppermost panel further includes an auxiliary zipperless access that is smaller than the closure member. In still another feature the primary lifting member includes a load spreading pad for engaging a shoulder of a person carrying the container, the pad having a lifting location that is higher than the centroid by a distance greater than the height of the container body. In yet another feature the container has another lifting member mounted to an outboard portion thereof, and is cooperable to meet the primary lifting member above the body whereby to permit the body to be carried as a hand satchel.

In still another feature the height is at least as great as the lateral depth. The container body has a four sided base panel, an upstanding peripheral wall that includes a front panel, a back panel, a first end wall and a second end wall, and a top panel all co-operating to define the insulated chamber therewithin. The first and second end walls are longitudinally spaced apart; the front and back panels is spaced apart laterally depthwise. The chamber having a liquid retaining liner mounted therein. The lid includes the closure member, and the closure member is hinged along a laterally inboard margin thereof. The primary lifting member includes a load distribution element at each end thereof. The load distribution elements pass loads into the first and second end walls both laterally inboard and laterally outboard of the centroid.

In another aspect of the invention there is a soft-sided insulated container assembly. It has a soft-sided insulated container, a primary lifting member and a secondary lifting member. The soft-sided insulated container has a front panel, a back panel and a pair of side panels. The front panel has a predominantly rectangular form. The rectangular form includes a pair of first and second generally opposed long sides, and a pair of first and second generally opposed short sides. The primary lifting member is mounted to the pair of side panels. The primary lifting member having a center of lift closer to the back panel than to the front panel. The secondary lifting member is mounted to the front panel by mounting members such that the secondary lifting member is closer to the first long side than the second long side. The first lifting member including a load spreading pad for engagement of a user's shoulder. The second lifting member including a bail for grasping engagement by a user's hand.

In still another aspect of the invention there is a soft-sided insulated container assembly that includes a soft-sided insulated container having two primary lifting members and a secondary lifting member. The soft-sided insulated container has a front panel, a bottom panel and a back panel. The front panel has a predominantly rectangular form, the rectangular plan form having a pair of first and second generally opposed long sides, and a pair of first and second generally opposed short sides. The first long side is proximate to the bottom panel and the second long side is distant therefrom. The primary lifting members are mounted to the front and back panels respectively. The secondary lifting member is mounted to the front panel closer to the first long the than to the second long side.

In an additional feature of that aspect, the secondary lifting member has a mounting that attaches to the bottom panel and distributes loads thereto.

BRIEF DESCRIPTION OF THE DRAWINGS

These and other aspects of the invention may be more readily understood with the aid of the illustrative Figures includes herein below, and showing an example, or example, embodying the various aspects of the invention, provided by way of illustration, but not of limitation of the present invention, and in which.

DETAILED DESCRIPTION

Figure 1A:
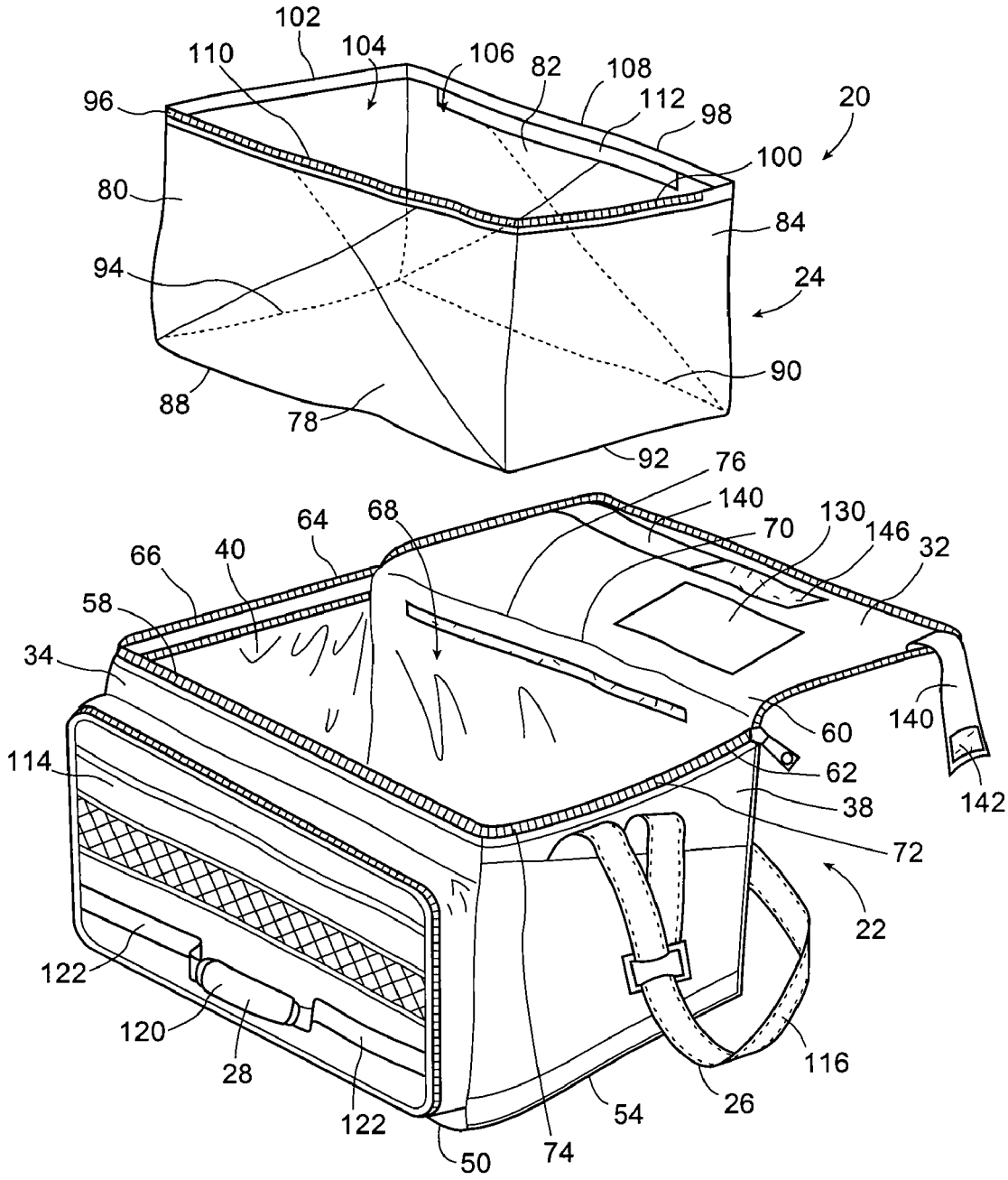
FIG. 1*a* shows an isometric view from in front and above and to one corner of an embodiment of an insulated container according to an aspect of the present invention.
Figure 1B:
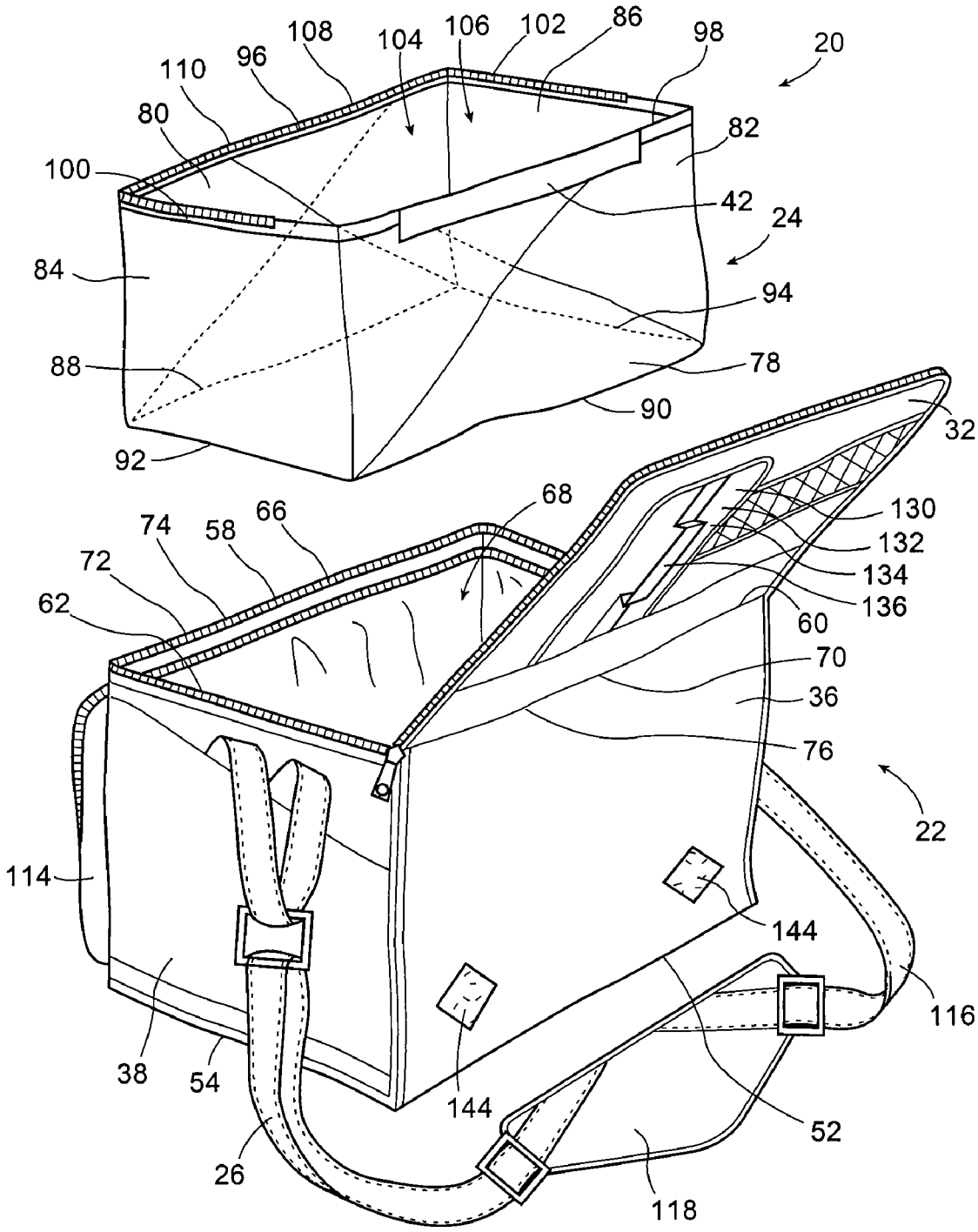
FIG. 1*b* is an opposite isometric view of the container of FIG. 1*a;*
Figure 1C:
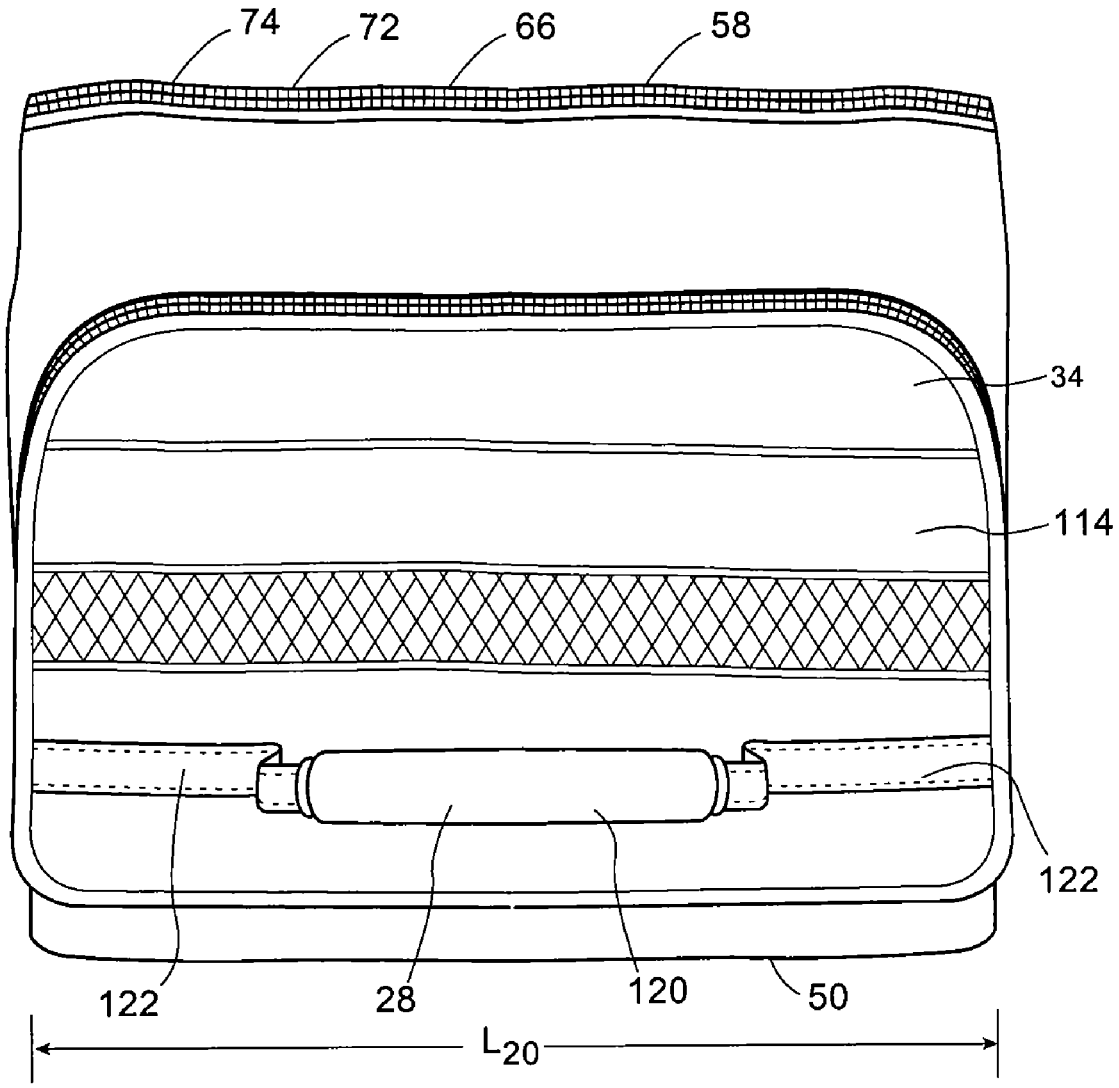
FIG. 1*c* is a front view of the container of FIG. 1*a;*
Figure 1D:
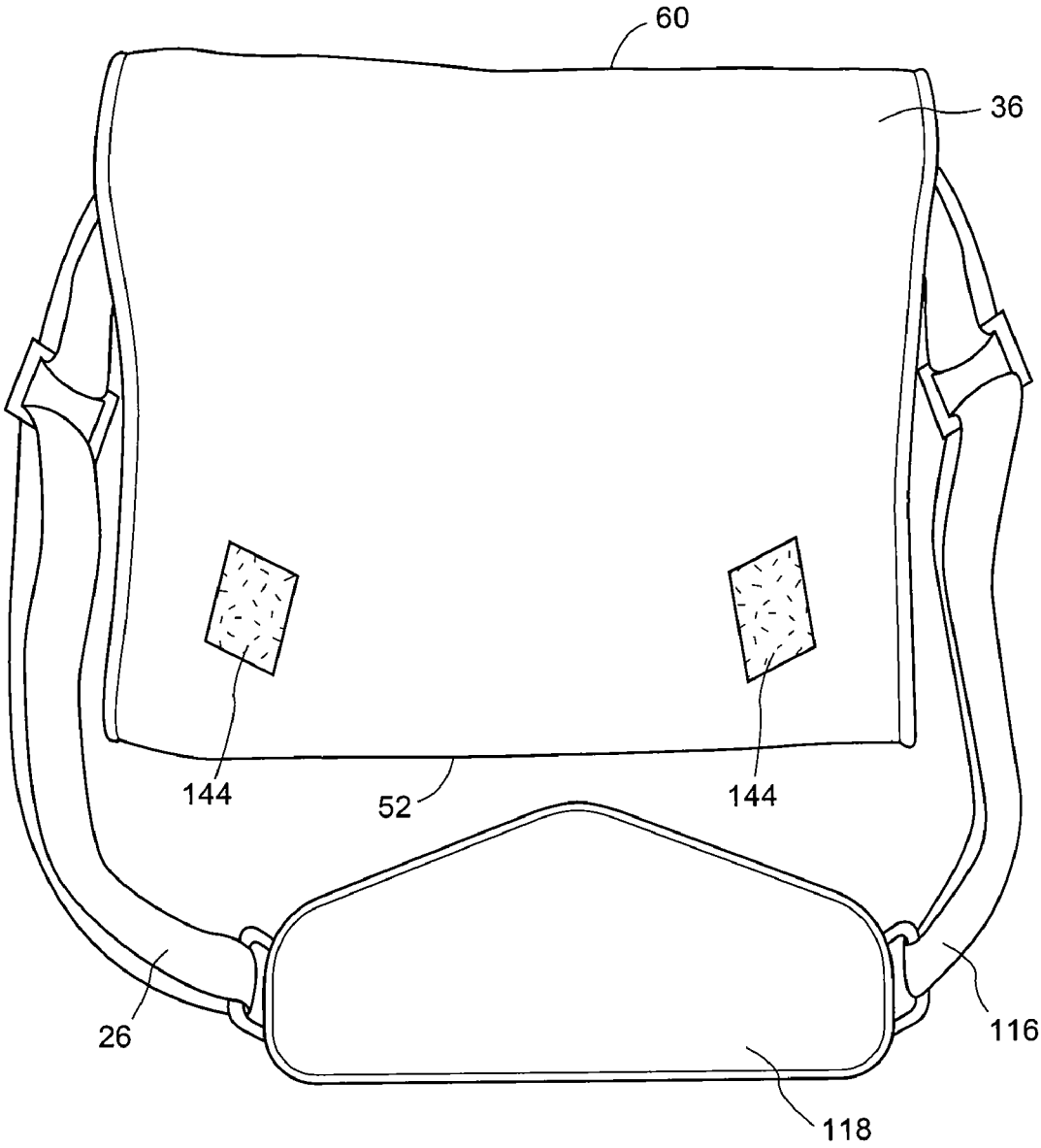
FIG. 1*d* is a rear view of the container of FIG. 1*a;*

The description that follows, and the embodiments described therein, are provided by way of illustration of an example or examples, of particular embodiments of the principles of the present invention. These examples are provided for the purpose of explanation, and not limitation, of those principles and of the invention. In the description, like parts are marked throughout the specification and the drawings with the same respective reference numerals. The drawings are generally roughly to scale unless noted otherwise. In some instances proportions may have been exaggerated in order more clearly to depict certain features of the invention.

A Cartesian frame of reference may be employed in which the long, or largest dimension of an object may be deemed to run in the direction of the x-axis, the base of the article, where substantially planar, may be considered to extend in an x-y plane, and the height of the article may be measured in the vertical, or z-direction. The largest panels of the containers described herein may be designated arbitrarily as the front and rear sides, faces, or portions of the container. Similarly, the closure member, or opening of the bag is arbitrarily designated as being at the top, and the base panel is designed as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which human food and human touch is accustomed, although the term cooler, or cooler container, or cooler bag, may be used, such insulated structures may generally be used to keep food, beverages, or other objects wither warm or hot as well as cool, cold or frozen.

Reference is made to insulated containers. The adjective "insulated" is intended to be given its usual and normal meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from Philips v. AWH Corp., this definition provided in the specification is intended to supplant any dictionary definition, and to prevent interpretation in the U.S. Patent Office (or any other Patent Office) that strays from the customary and ordinary meaning of the term "insulated" as provided.

Similarly, this description may tend to discuss various embodiments of soft-sided containers, as opposed to hard-shell containers. In the jargon of the trade, a soft-sided cooler, or bag, or container, is one that does not have a substantially rigid, high density exoskeleton (typically a molded shell, e.g., of ABS or polyethylene, or other common types of molded plastic). Rather, a soft-sided container may tend to have, for example, an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam. A soft-sided container may still be a soft-sided container where, as described herein, it may include a substantially rigid liner, or may include one or more battens (which may be of a relatively hard plastic) concealed within the soft sided wall structure more generally, or where hard molded fittings may be used either at a container rim or lip, or to provide a base or a mounting point for wheels, but where the outside of the assembly is pre-dominantly of soft-sided panels. Again, this definition is intended to forestall the U.S. Patent Office (or any other Patent Offices), from adopting an interpretation of the term "soft-sided" that diverges from the ordinary and the customary meaning of the term as understood by persons of ordinary skill in the art, and as explained herein.

FIGS. 1*a* to 1*h* and 2*a* to 2*f* show an example of an insulated container assembly 20 in embodying an aspect of the invention. The insulated container assembly 20 may include a soft-sided insulated container 22, a removable, impermeable liner 24, a first or primary lifting member 26 and second or secondary lifting member 28.

The soft-sided insulated container 22 may have the general form of a generally six-sided box, or enclosure, having a first or bottom panel 30, a second or top panel 32, a third or front panel 34, a fourth or back panel 36, and a pair of left and right side panels 38 and 40. In some embodiments the first panel 30 has a generally rectangular form, defined by a pair of first and second generally opposed long sides, or margins, 42, 44 and a pair of first and second generally opposed short sides, or margins, 46, 48. The first panel 30 may have radiused corners. While, in the most general sense, the first and second panels 30, 32 may have generally planar forms, and may be polygons, and may be quadrilaterals, whether of equal or unequal size, or of the same or different profiles or footprints, it may often be convenient for the first and second panels 30 and 32 to have substantially the same plan form profile or footprint, and for them to be spaced apart and parallel, such that the normal projection of one may lie upon, or substantially or predominantly upon, the other.

Each of the third, fourth, left side and right side panels 34, 36, 38, 40 may have a first or bottom side or margin 50, 52, 54, 56 and an opposing second or top side or margin 58, 60, 62, 64. The first and second margins 50, 52, 58, 60 of the third and fourth panels 34, 36 are long margins that correspond to the long sides, or margins, 42, 44 of first panel 30, and the first and second margins 54, 56, 62, 64 of the left and right side panels 38, 40 correspond to the short sides, or margins, 46, 48 of first panel 30. The first margins 50, 52, 54, 56 of the third, fourth, left side, and right side panels 34, 36, 38, 40 are joined to the corresponding margins 42, 44,46, 48 of first panel 30 and may extend away from first panel 30 such that the second margins 58, 60, 62, 64 may form a rim or periphery 66 with which second panel 32 may cooperate.

The structure thus described defines a thermally insulated internal space, or cavity, chamber or accommodation, indicated generally as 68. Access to accommodation 68 may be obtained by mounting second panel 32 in a movable condition, such that second panel 32 may move between an open condition (FIGS. 1*a*, 1*b*) and a closed condition (FIG. 1*h*) with respect to rim 66, and with respect to accommodation 68 more generally. To this end, second panel 32 may be pivotally or hingedly mounted to rear panel 36, and in particular, may have a long side or margin 70 that is mounted to the top side or margin 60 of rear panel 36 such that second panel 32 may swing in the manner of a door, or first closure, operable to govern access to accommodation 68.

In this structure, the long or lengthwise structure overall dimension $L_{20}$ in the x-direction may tend to be greater than the lateral depth or breadth-wise dimension in the y-direction $W_{20}$, each of which may tend to be greater than the height or vertical depth or thickness $H_{20}$ in the z-direction measured normal to first and second panels 30 and 32. Indeed, $L_{20}$ may tend to be in the range of 1 $W_{20}$ to 1.5 $W_{20}$, and may tend to be in the range of 2 to 5 times $H_{20}$. In one embodiment, the ratio of proportions $L_{20}$: $W_{20}$: $H_{20}$ may be roughly 5:4:2, (all +/−30%). In a typical embodiment, container assembly 20 may tend to be employed as a beverage cooler for cans such as the 355 ml cans noted above, whether 6, 12, 20, 24, 40 or 50, as may be.

Insulated container assembly 20 may include a securement in the nature of a releasable fitting 72, such as may be operable to retain the second panel 32 in the closed position. Fitting 72 may be a friction fit, or interference fitting or bead, or lip, which may either be discrete or which may run in a substantially continuous manner about a portion or all of the rim 66. Fitting 72 may include mating hook and eye attachment fittings (of which one type is sold under the name Velcro™), or it may be in the nature of a tracked fastener, of which one type is a zipper. In one embodiment, zipper 74 may extend about those portions of rim 66 not connected by hinge 76, namely the second margins 58, 62, 64 of the third or front, left side and right side panels 34, 38, 40. Hinge 76 may be in the nature of a living or fabric hinge or flap, as may be.

Liner 24 may be a flexible liner that may be attached about rim 66, and may be on the inside thereof completely within the enclosure. Liner 24 has a base 78, and four sides, font, rear, left hand, and right hand respectively, 80, 82, 84, 86 extending upwardly from base 78. Each of sides 80, 82, 84, 86 is joined to base 78 at a base edge or margin 88, 90, 92, 94, as indicated, and each has an opposite distal edge or margin 96, 98, 100, 102 distant from its base edge or margin. A chamber 104 is defined between base 78 and sides 80, 82, 84, 86. Chamber 104 has an opening 106 defined by the rim 108 formed collectively by distal edges 96, 98, 100, 102 of sides 80, 82, 84, 86. Liner 24 may be a seamless folded liner made of vinyl or sheet stock, and may be translucent, or see-through. Liner 24 may be invertible and washable.

Liner 24 may be permanently installed, as by sewing around the periphery at rim 66, or it may be removably installed with liner support fasteners 110. In some embodiments the liner support fasteners 110 are of the nature of a continuous zipper around three sides of the rim 108, and a fastener 112 in the nature of a fabric hook-and-eye strip are sewn in place with stitching that is at an height relative to base 78 that is expected to be well above the liquid level in liner 24. In other embodiments, fasteners 110 are all fabric hook and eye fasteners each mounted on one side of the rim 108, and which mate with corresponding hook-and-eye fasteners strips mounted to the soft-sided insulated container 22. These fastener strips are commonly sold under the name Velcro™.

Alternately or optionally, insulated container assembly 20 may include a secondary wall structure such as may be designated as a secondary or auxiliary pocket or pouch 114 mounted externally to the soft-sided insulated container 22. Auxiliary pouch 114 may have an insulated wall structure, or may have a non-insulating retaining lodgement. It may be that auxiliary pouch 114 is mounted to the front panel 34.

The first or primary lifting member 26 of the insulated container assembly 20 may be attached at one or more locations. In one embodiment, first lifting member 26 may have the form of a shoulder strap 116 mounted to a top portion of left and right side panels 38 and 40. Strap 116 may be mounted eccentrically relative to the vertical centerline of left and right side panels 38 and 40, and may be mounted to ascend at an angle shown as angle [alpha] which may be in the range of perhaps 65-80 degrees from horizontal (10-25 degrees from vertical). An extension of the centreline of strap 116 to bottom panel 30 may tend not to intersect the centroid C of the left or right side panel 38 or 40, but rather pass between centroid C and back along left or right side panel 38 or 40.

In some cases the strap 116 is a single continuous strap and in other cases the strap 116 includes, or is, an assembly of straps. Strap 116 may include a main or central portion 111, to which a central load spreader, identified as pad 118, may be mounted to spread the weight of the insulated container assembly 20 across the carrier's shoulder. In one form pad 118 may be generally triangular (or trapezoidal), with the base side of the triangle (or long side of the trapezoid) being for placement over the wearer's shoulder away from the neck, and the point or apex of the triangle (or short side of the trapezoid) toward the neck.

Figure 1E:
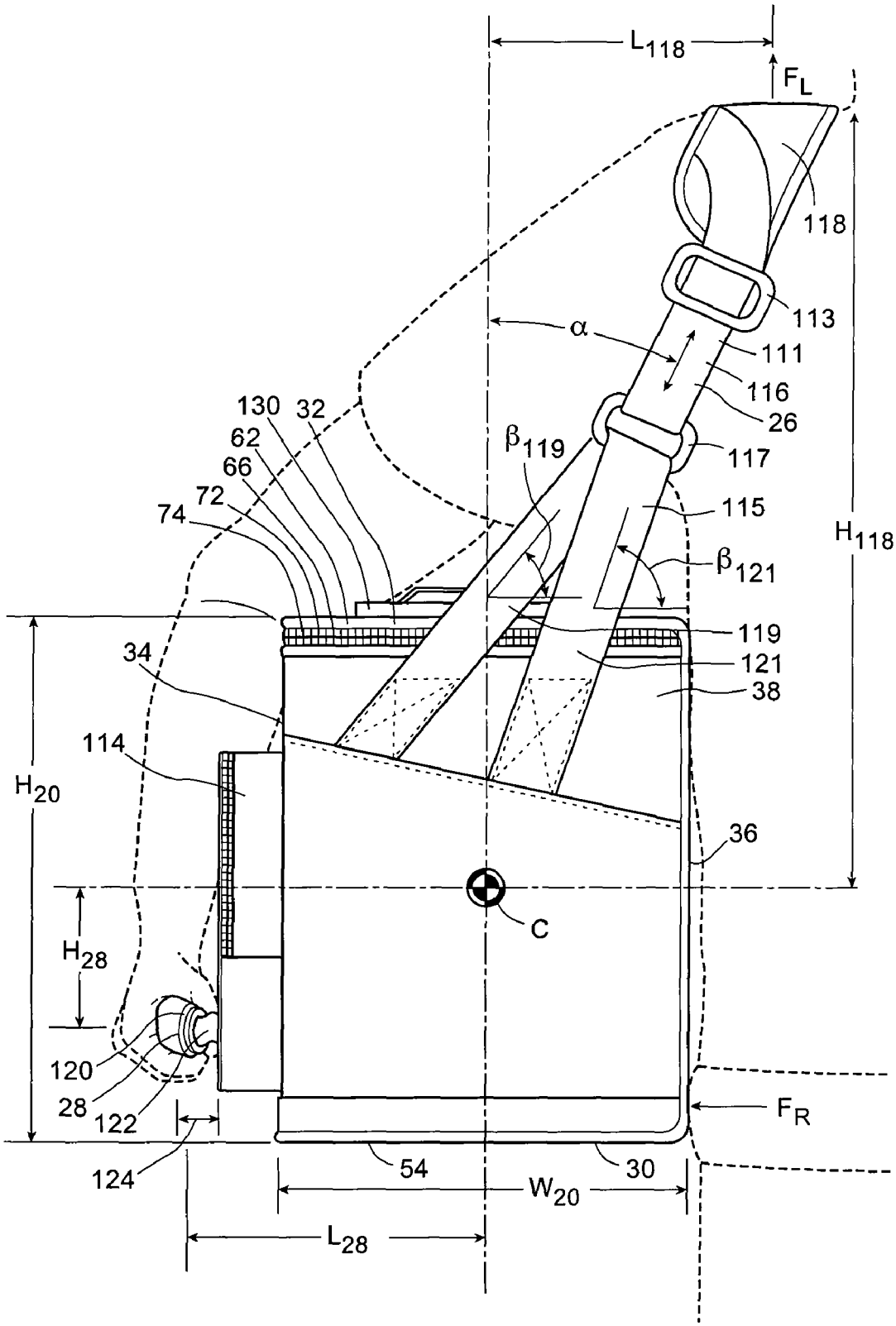
FIG. 1*e* is a left hand side view of the container of FIG. 1*a*, shown as carried by a person.
Figure 1F:
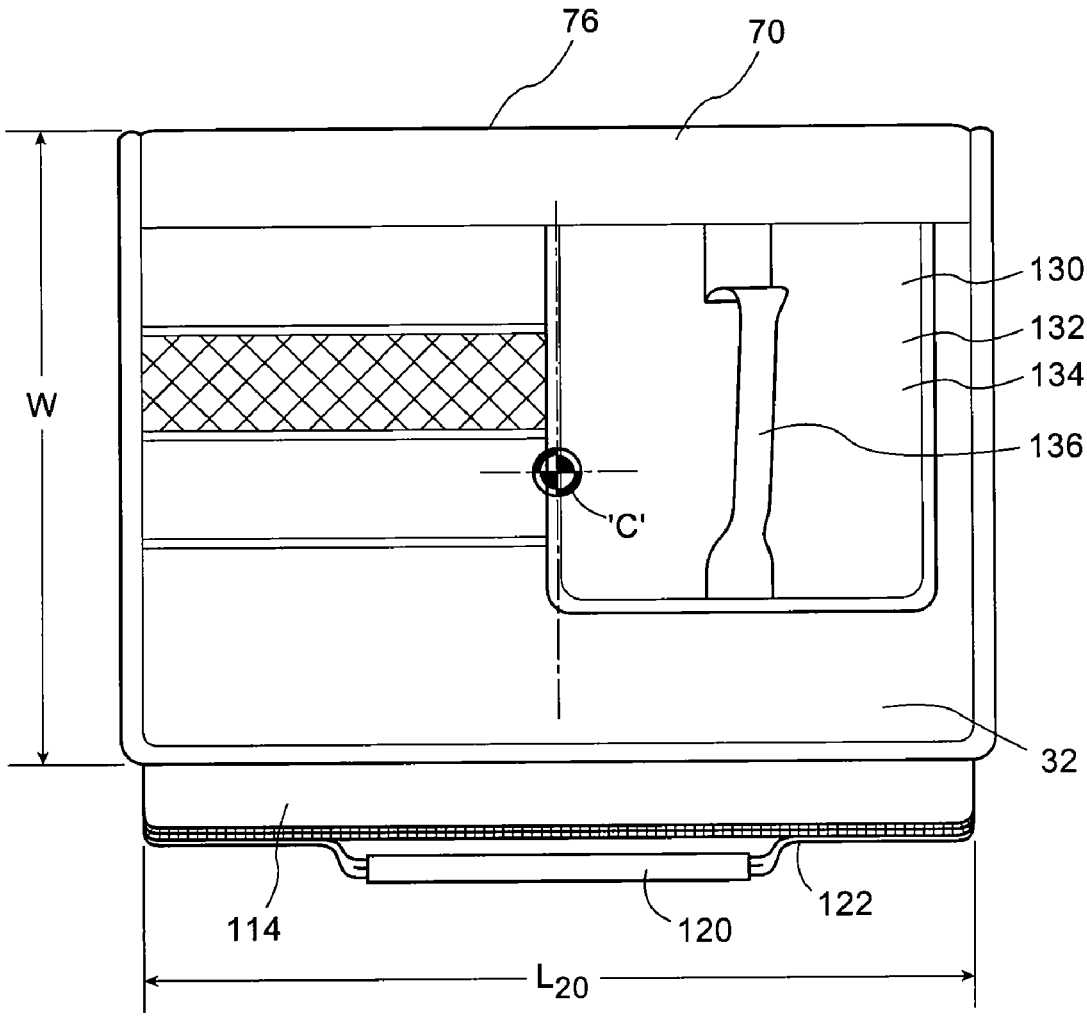
FIG. 1*f* is a top view of the container of FIG. 1*a;*
Figure 1G:
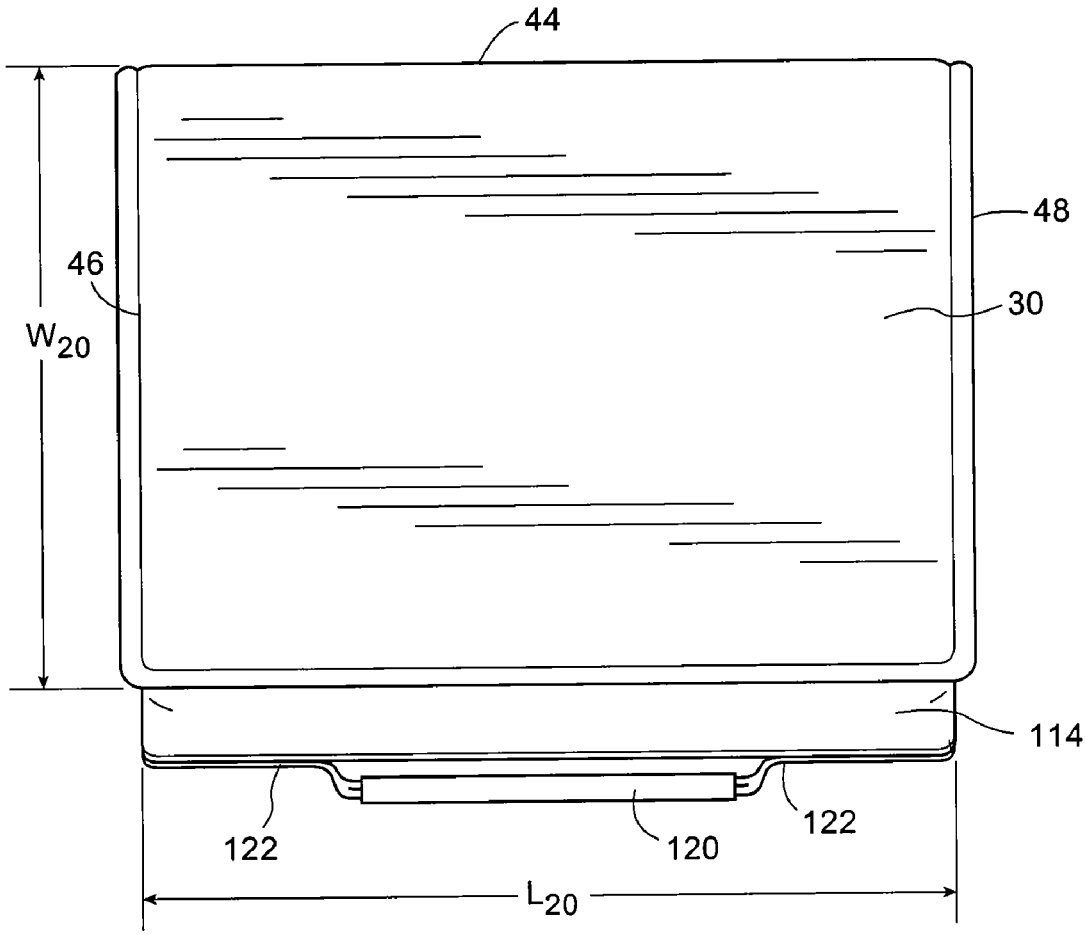
FIG. 1*g* is a bottom view of the container of FIG. 1*a;*
Figure 1H:
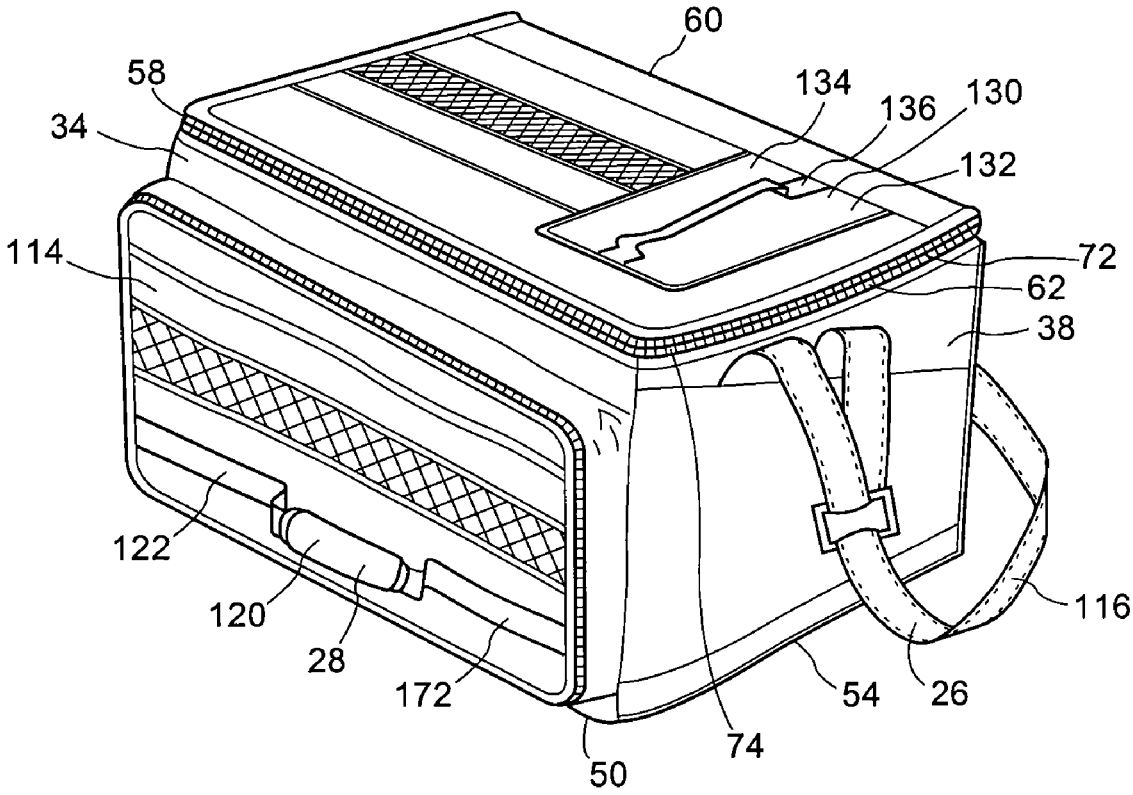
FIG. 1*h* is a view of the container of FIG. 1*a* in a closed condition.
Figure 2A:
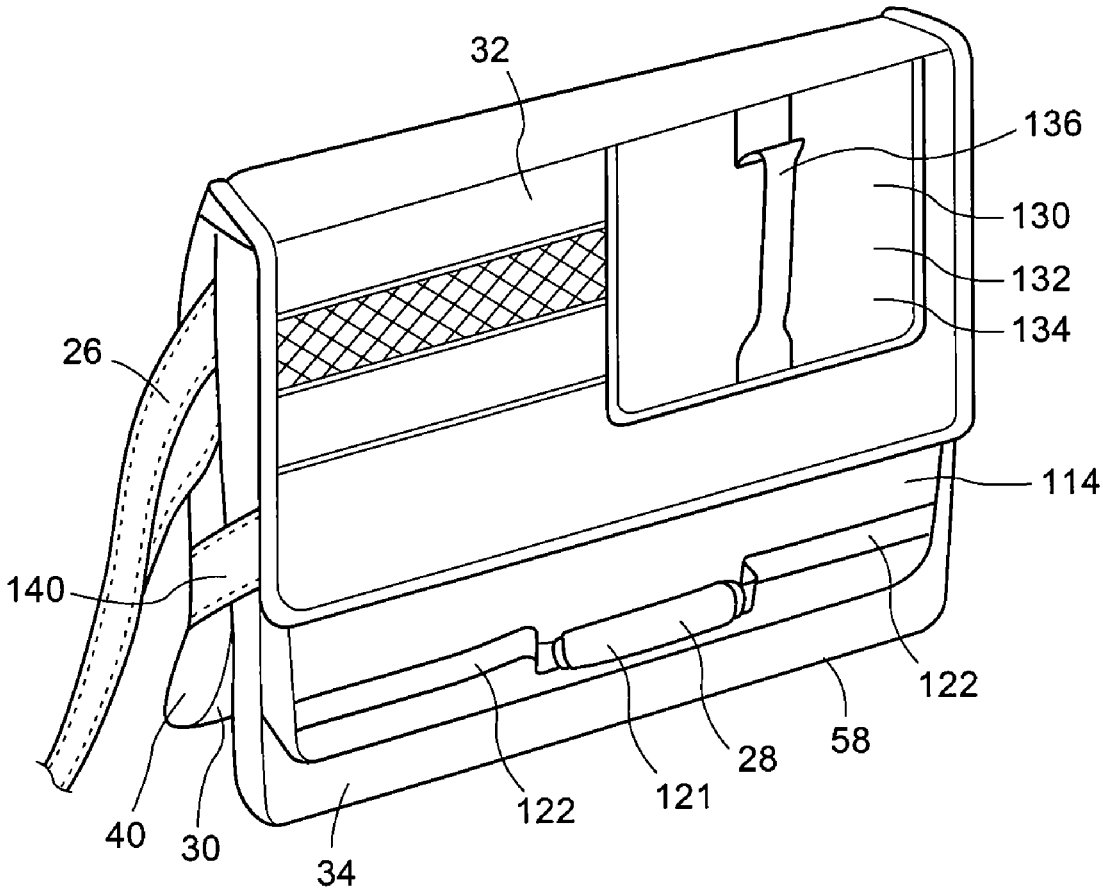
FIG. 2*a* is an isometric view of the container of FIG. 1*a* in a collapsed condition.
Figure 2B:
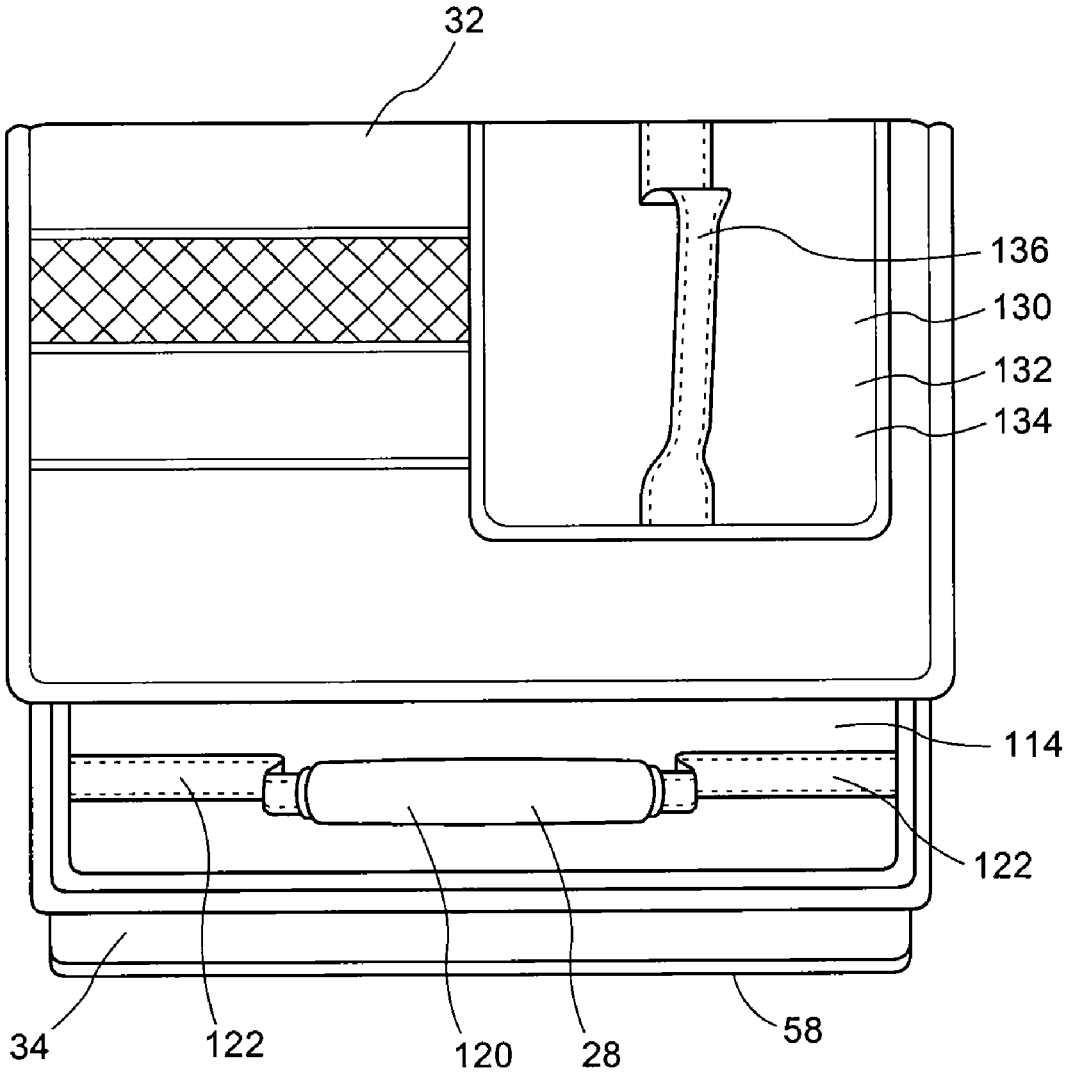
FIG. 2*b* is a front view of the container of FIG. 2*a;*
Figure 2C:
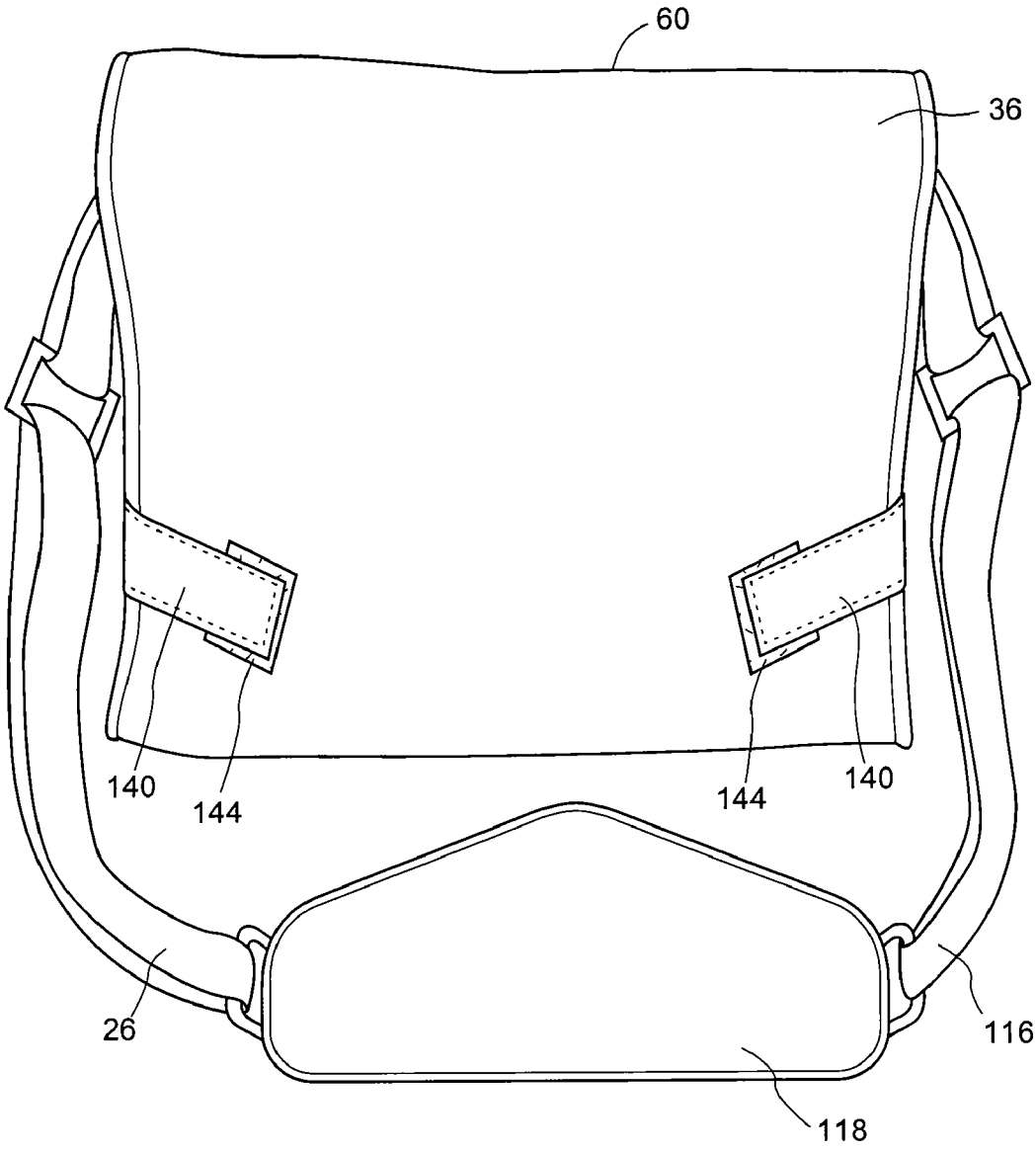
FIG. 2*c* is a rear view of the container of FIG. 2*a;*
Figure 2D:
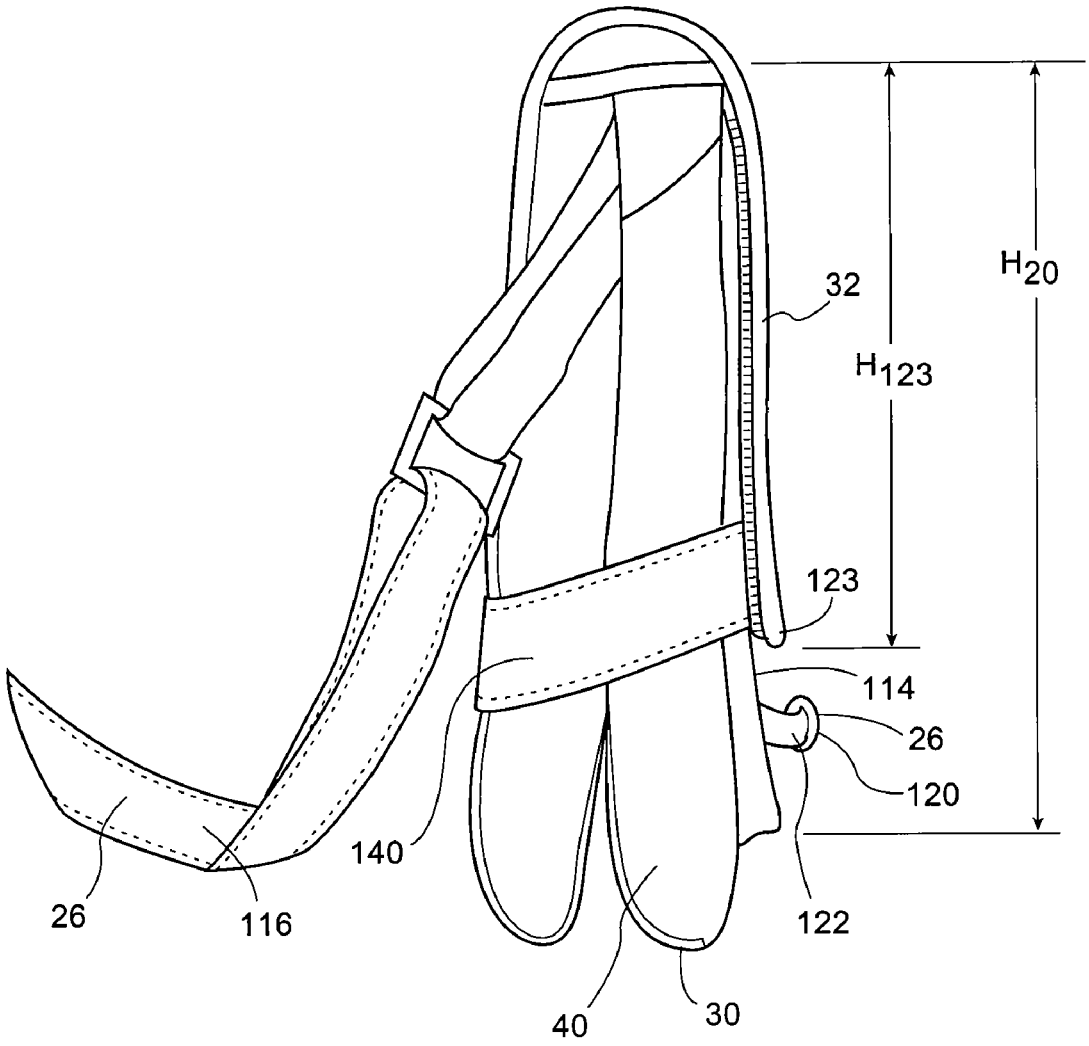
FIG. 2*d* is a right hand side view of the container of FIG. 2*a;*
Figure 2E:
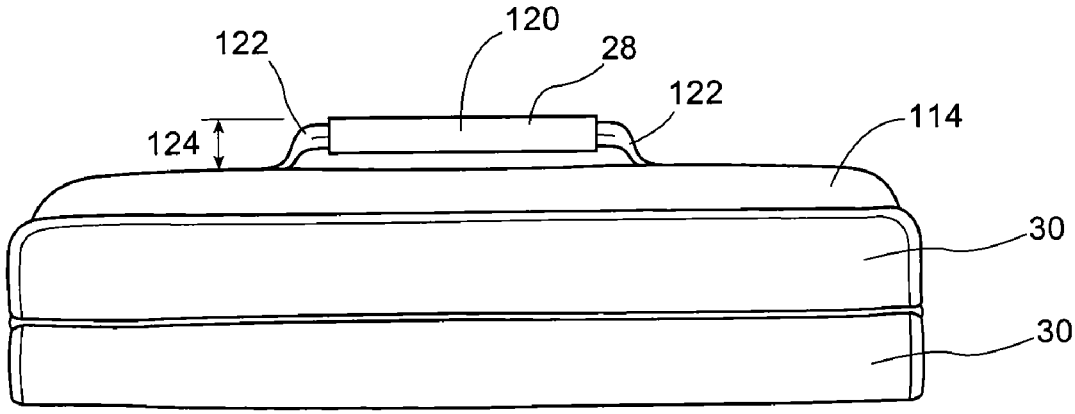
FIG. 2*e* is a top view of the container of FIG. 2*a;*
Figure 2F:
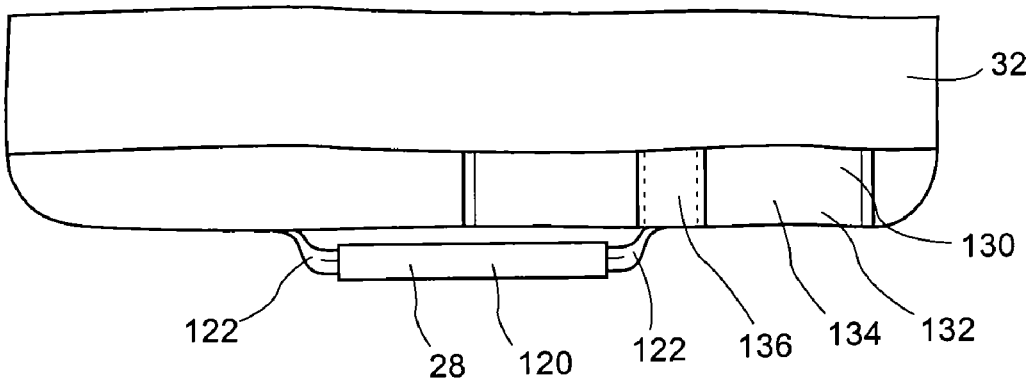
FIG. 2*f* is a bottom view of the container of FIG. 2*a;*

Strap 116 may also include an adjustment, or adjustments, such as slide buckles 113 to permit variation of the length of the components of central portion 111 of strap 116. This length adjustment alters the height at which the assembly is carried on the carrier's body (FIG. 1*e*, $H_{118}$,) and the relative difference in height between the lifting pad 118 on the strap, and the height of outboard handle, namely secondary lifting member 28 (FIG. 1*e*, $H_{28}$). The hight of application of force on item 118 may be roughly the height of the container body, $H_{20}$, above the top panel, or may lie in the range of about 3:4 to 3:2 of $H_{20}$ above the height of the top panel. It may be noted that the line of action of the lifting force on pad 118 is inboard of the inside face of back panel 36, and may be offset from the centroid by a distance $L_{118}$. Similarly, the lateral distance to the secondary lifting member 28 from the centroid is shown as $L_{28}$. These two lateral distances are roughly comparable, being in the range of 2:3 to 3:2 of each other. In use, $H_{28}$ may be in the range of ¼ to ½ of the height of the cooler body generally, indicated as $H_{20}$. As indicated, member 28 lies below the centroid, whereas pad 118 is located on the shoulder well above the level of the centroid. In the illustration a lateral reaction is shown as $F_R$, applied by the body of the person carrying assembly 20 at roughly hip level, that being, more or less the same as the level of the bottom of assembly 20, which may also be relatively close to, or at, the level of member 28 (within +/−20% of $H_{20}$, for example). In the closed position, shown in FIG. 2*e*, the height $H_{123}$, of the lower margin 123 of top panel 32, as folded, is less than $H_{20}$, such that the lid, as folded for storage, does not cover over handle 120.

Strap 116 (or strap assembly, 116, as may be) may also include a pair of end spreaders 115, such as may have the form of a two legged strap with a loose hard eye 117. The two legs 119, 121 each have a root secured to the end panel, be it 38 or 40. The legs meet at a fold over one side of hard eye 117. The location of the fold may be fixed by fixing the lengths of legs 119, 121 relative to each other, as by stiching them together, and entrapping hard eye 117. Central portion 111 wraps about the other side of hard eye 117. As may be noted, the root of one leg 119 lies inboard of the centroid, and the root of the other leg 121 lies outboard. Inboard leg 121 ascends at an angle from the horizontal that is steeper than the outboard leg, the respective angles $beta_{119}$ and $beta_{121}$ being in the range of 70-85 degrees (in one embodiment about 78 degrees) and 55-75 degrees (in one embodiment about 65 degrees) from the horizontal.

The secondary gripping, or stabilizing or lifting member 28 of the insulated container assembly 20 may also be attached at one or more locations. In one embodiment, second lifting member 28 may have the form of a grip or handle 120 mounted to the front side of soft-sided insulated container 22. In cases where insulated container assembly 20 includes an auxiliary pouch 114 (FIGS. 1*a* to 1*h* and 2*a* to 2*f*) the handle 20 may be mounted to auxiliary pouch 114. In other cases handle 20 may be mounted directly to front panel 34. As noted above, handle 120 may be mounted below the vertical midway point ($H_{20}/2$) of soft-sided insulated container 22. In some embodiments handle 120 is mounted to auxiliary pouch 114 using straps 122 that run substantially horizontal to bottom margin 50 of front panel 34. Straps 122 may be attached to handle 120 such that there is a space 124 between handle 120 and auxiliary pouch 114. Space 124 allows the user or carrier of the insulated container assembly 20 to at least part of the hand between auxiliary pouch 114 and handle 120 permitting the user to grip or hold onto handle 120. This asymmetric arrangement allows lifting on both the inside and outside of the bag; it may allow the hand to hold on the outside of the bag and to stabilise the bag in terms of motion around the carrier's hip, and, finally, it may permit the user to hold the bag in a manner that may tend to reduce fatigue in the carrier's arm.

In summary, there is a soft-sided insulated container assembly that has an asymmetric lifting arrangement. The container has a long dimension to which, in use, the carrier's hips are oriented cross-wise. That is, if the person carrying the container is walking forward, the long dimension of the bag is generally oriented in a direction more or less parallel with the direction in which the person is walking. In this embodiment the container may tend to be longer than high, and higher than deep. In one embodiment the ratio of length L, to height H, to depth W, may be of the order of 14:12:10 (all +/−20%). The container has a primary lifting member, namely strap 116, that has longitudinally spaced lifting connections, those connections stradling the centroid of the container longitudinally. That is, spreader members 115 are mounted to the long ends of the container such that the center of mass in the container, in any loading condition, must lie somewhere intermediate the two longitudinal stations, namely the end walls 38, 40, at which lifting forces are applied. The spreader members themselves are mounted to transmit vertical shear into the endwalls 38, 40 in a distributed manner, whether through two (or more) legs such as legs 119, 121, or in a triangular flap or gusset. The connection of these spreader roots lies above the centroid of the endwall, such that the center of lift may tend to lie above the center of mass when the container is loaded. The soft-sided insulated container assembly also includes a secondary lifting or holding member, namely outside or outboard handle 120. This handle is mounted longitudinally intermediate the lifting points or regions of the primary lifting member. That is, handle 120 is mid-way along the body of container assembly 20 whereas strap 116 lifts at the location of the application of forces of spreaders 115 at either end of assembly 20. Further, the centroid of the container lies between the location of application of the lateral reaction force of the carrier's body and handle 120. In addition, the centroid of the container assembly lies between the location of application of inboard and outboard lifting forces at items 118 and 120 respectively. In some embodiments, handle 120 may tend to be longitudinally in line with the carrier's hips, or, expressed differently, the handle may be on a radius the runs through the center of the container (as viewed from above) and through the wearer's hips, so that, when held, it may tend to discourage rotation about a vertical axis of rotation relative to the carrier's hips, and thereby to stabilise the position of assembly 20 on the hip while it is being carried. Alternatively, handle 120 may facilitate such motion if and when desired, such as to dispense objects from the container. The motion is then stabilised such that undesired swaying or migration about the hips may be reduced. Thus the centroid, which may be taken as a proxy for presumed center of mass when loaded, is bracketed between the applied vertical forces longitudinally (i.e., in the x-direction) and in the inboard-outboard direction (i.e., the y-direction), and in terms of loads tending to rotate container assembly 20 about the vertical axis (or z-direction). The location may also be such as to place the crook of the carrier's elbow generally adjacent to the upper outboard vertex of the container which may, again, tend to aid in facilitating stabilization of container assembly 20 against the carrier's torso during transport.

Alternately, or optionally, insulated carrier assembly 20 may include an auxiliary access 130 to accommodation 68 in the nature of a lid or door 132 mounted as an inset in second panel 28. Auxiliary access 130 may have an insulated wall structure, and may include a wing 134, hingedly mounted to the main body of second panel 32. Door 132 may employ a different type of securement from the main closure securement of second panel 32. That is, whereas the main closure may employ a zipper, e.g. 74, and may work to permit general access to accommodation 68 for loading, or for addition or removal of, for example, ice. Door 132, by contrast, may be rather smaller, and may have a quick release fastener (such as Velcro™ strips), and may be of a size to permit a user to reach in and extract, an individual beverage can, without having to open the whole upper portion of the container assembly 20. Door 132 may also have a handle 136 that allows the user to easily open door 132 to gain access to accommodation 68. Door 132 may be of substantially the same, or predominantly the same construction as the other insulated portions of container assembly 20 more generally. Optionally, insulated container assembly 20 might also include external beverage holders, or auxiliary pockets, or lodgements, whether insulated or uninsulated.

The wall structure of the soft-sided insulated container 22 may typically include an outer layer or skin, an internal layer (or layers) of insulating material, and an inner layer or skin. Insulating material may itself be a sandwich of insulating layers, or sub layers, such as a closed cell foam layer, an open cell foam layer, and a closed cell foam layer. It may be that the outer layer, may tend to be made of a relatively wear resistant material, be it a woven polyester material or some other. The internal layer may be a sheet of Nylon, and may have a reflective inner surface. Optionally, one or more panels may have stiffening battens mounted therein, e.g., it may be desired that the first panel 30 be stiffened for suitability as a base upon which to rest insulated container assembly 20, either when resting in the opened position or when standing in the closed position. In that case, either may include a reinforcement or stiffener.

Container 22 with liner 24 installed can be folded into a collapsed condition as shown in FIGS. 2*a* to 2*g*. In this collapsed, or storage, condition, left and right side panels 38, 40 fold inward, and first panel 30 folds upwards. This permits front panel 34 to move towards rear panel 36. Second panel 32 is then drawn forward and downward in front of front panel 34 and auxiliary pouch 114. Second panel 32 has mounted to its inner face a plurality of retainers 140 with a hook and eye fastener strip 142. The retainers 140 are drawn around so fastener strips 142 engage with fastener strips 144 mounted to the outer, rearward face of rear panel 36. When container 22 is in the open condition, straps 140 can engage storage strip 146 located on the inner face of second panel 32 to be stored or kept out of the way.

Figure 3A:
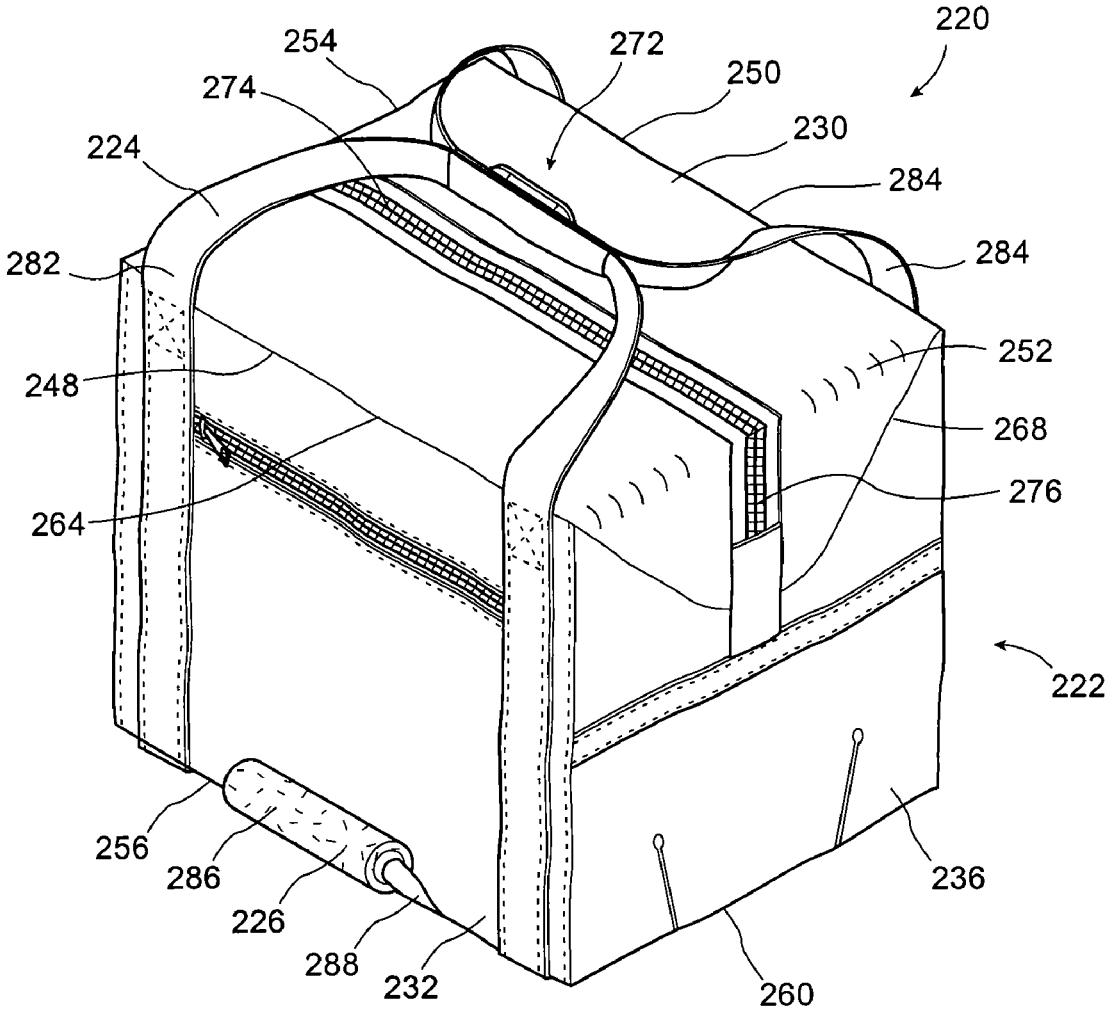
FIG. 3*a* shows an isometric view from in front, above and to one corner of an alternate embodiment of an insulated container to that of FIG. 1*a;*
Figure 3B:
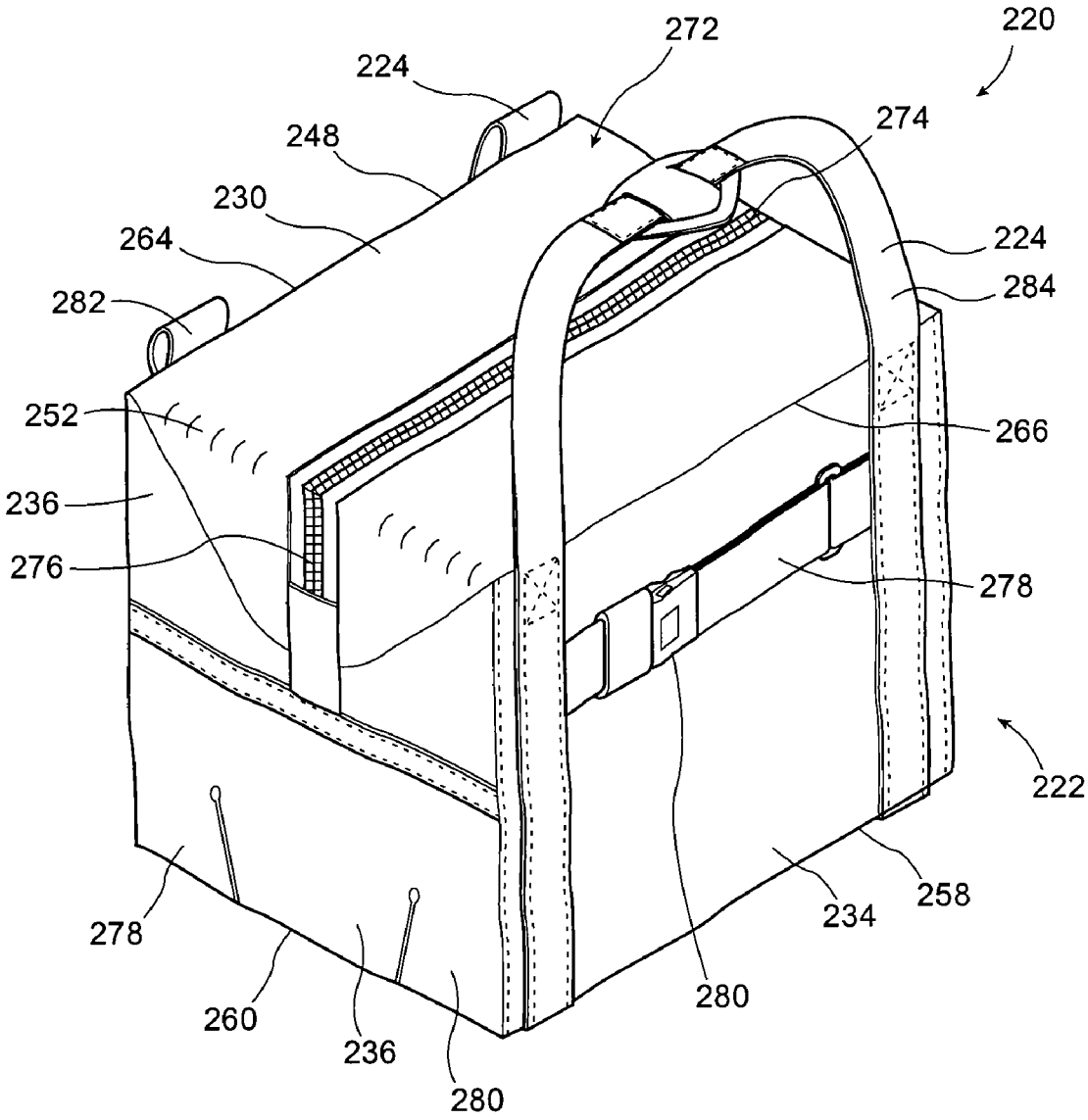
FIG. 3*b* is an alternate isometric view of the container of FIG. 3*a* from in front, above, and to the other front corner.
Figure 3C:
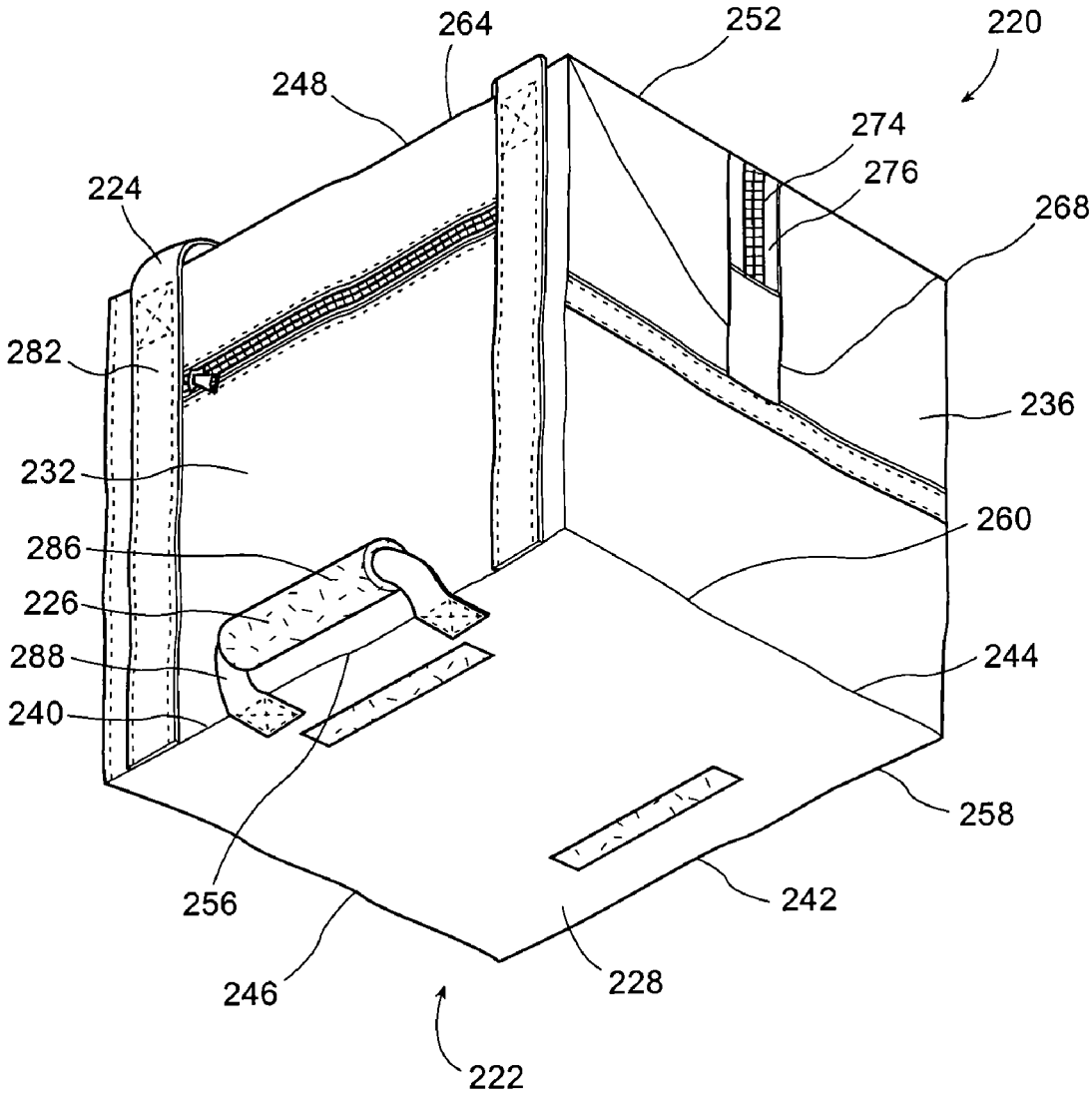
FIG. 3*c* is a further alternate isometric view of the container of FIG. 3*a* from in front, below, and to one corner.

In another embodiment, in FIGS. 3*a* to 3*c*, a soft insulated container assembly 220 may include a soft-sided insulated container 222, a first or primary lifting member 224 and a second or secondary lifting member 226.

The soft-sided insulated container 222 may have the general form of a generally six-sided box, or enclosure, having a first or bottom panel 228, a second or top panel 230, a third or front panel 232, a fourth or back panel 234, and a pair of left and right side panels 236 and 238. In some embodiments the first panel 228 has a generally rectangular form, defined by a pair of first and second generally opposed long sides, or margins, 240, 242 and a pair of first and second generally opposed short sides, or margins, 244, 246. The first panel 228 may have radiused corners. The second panel 230 may also have a generally rectangular form, defined by a pair of first and second generally opposed long sides, or margins, 248, 250 and a pair of first and second generally opposed short sides, or margins, 252, 254.

Each of the third, fourth, left and right side panels 232, 234, 236, 238 may have a first or bottom side or margin 256, 258, 260, 262 and an opposing second or top side or margin 264, 266, 268, 270. The first margins 256, 258 of third and fourth panels 232, 234 are long margins that correspond to the long sides, or margins, 240, 242 of first panel 228, and the first margins 260, 262 of the left and right side panels 236, 238 correspond to the short sides, or margins, 244, 246 of first panel 228. The first margins 256, 258, 260, 262, of third, fourth, left side, and right side panels 232, 234, 236, 238 are joined to corresponding margins 240, 242, 244, 246 of first panel 228 and may extend away from first panel 228. The second margins 264, 266 of the third and fourth panels 232, 234 are long margins that correspond to the long sides, or margins, 248, 250 of second panel 230, and the second margins 268, 270 of the left and right side panels 236, 238 correspond to the short sides, or margins, 252, 254 of second panel 230. The second margins 264, 266, 268, 270 of the third, fourth, left side, and right side panels 232, 234, 236, 238 are joined to the corresponding margins 248, 250, 252, 254 of second panel 230.

The structure thus described may tend to define a thermally insulated internal space, or cavity, or accommodation, indicated generally as 272. Access to accommodation 272 may be obtained by installing a tracked fastener 274, such as a zipper 276 in the top panel 230. In some embodiments the zipper 276 may extend substantially parallel to the long sides 248, 250 of the second panel 230. Zipper 276 may also extend into the left and right side panels 236, 238 as shown in FIG. 3*a* to create a larger opening to access accommodation 272.

The rear panel of container 222 may have a securement 278 in the nature of a longitudinally running strap with a releasable clasp 280. The strap may be of adjustable length, and may run in the longitudinal direction. The ends of the securement member may be rooted or attached to the vertical webbing of the roots of the straps of primary lifting member 224, in such manner as may tend to distribute loads into the panel. Securement 278 is located above the height of the centroid. As noted, container assembly 220 may be quite heavy when fully loaded. In those circumstances it may be carried on a pallet, or cart, or dolly having a platform or forks that support the bottom panel. The dolly may include stanchions, or posts, or a frame that stands upwardly away from the platform or forks. Securment member 278 may be secured about that frame, and cinched tight to secure container 220 for transport.

In one embodiment, the primary lifting member 224 includes front and rear carrying handles 282 and 284 with reinforced bails attached to both front panel 232 and 234. Front and rear carrying handles may be used by a single carrier or user to lift or transport the soft insulated container assembly 220 in the manner of a satchel, or travelling grip or duffel bag. Alternatively they may be used by two users or carriers to support assembly 220 between them. The front and rear carrying handles 282 and 284 may include attachment straps which can be used to attach front and rear carrying handles 282 and 284 together.

In one embodiment, second lifting member 226 may have the form of an handle 286 mounted to the front panel 232 of the soft-sided insulated container 222. Handle 286 may be mounted below the vertical midway point (H/2) of front panel 232. Handle 286 may be mounted to front panel 232 using straps 288 that run substantially perpendicular to bottom margin 256 of front panel 232. In some embodiments the ends or roots of straps 288 extend at least partially across, and attach to, the underside of bottom panel 228 so that when a user or carrier pulls on handle 286 straps 288 aid in lifting container 220 and in spreading the tension into panel 228. The straps 288 may be attached to the handle 286 in such a manner that there is a space 290 between the handle 286 and the front panel 232. The space 290 allows the user or carrier of the insulated container assembly 220 to place their hand or at least part of their hand between the front panel 232 and the handle 286 so they can grip or hold onto the handle 286.

As with container assembly 20, container assembly 220 is thus provided with an asymmetric lifting arrangement that includes an inboard, upper lifting member that is eccentrically mounted relative to the centroid of the container body, and a lower, outboard grip that is located below the centroid height. The container can therefore be carried over the shoulder, and stabilised by the generally downwardly hanging hand of the user.

The wall structure of the soft-sided insulated container 222 may typically include an outer layer or skin, an internal layer (or layers) of insulating material, and an inner layer or skin. Insulating material may itself be a sandwich of insulating layers, or sub layers, such as a closed cell foam layer, an open cell foam layer, and a closed cell foam layer. It may be that the outer layer, may tend to be made of a relatively wear resistant material, be it a woven polyester material or some other. The internal layer may be a sheet of Nylon, and may have a reflective inner surface. Optionally, one or more panels may have stiffening battens mounted therein, e.g., it may be desired that the first panel 228 be stiffened for suitability as a base upon which to rest insulated container assembly 220, either when resting in the opened position or when standing in the closed position. In that case, the first panel 228 may include a reinforcement or stiffener.

Soft insulated container assembly 20 and soft insulated container assembly 220 may include any combination of primary and second lifting members 26, 28, 224, 226 described above. For example the soft insulated container assembly 20 may include primary lifting member 224 and secondary lifting member 226, or alternatively primary lifting member 26 and secondary lifting member 226. Similarly, soft insulated container assembly 220 may include, for example, primary lifting member 26 and secondary lifting member 28, or primary lifting member 224 and secondary lifting member 28.

The principles of the present invention are not limited to these specific examples which are given by way of illustration. It is possible to make other embodiments that employ the principles of the invention and that fall within its spirit and scope of the invention. Since changes in or additions to the above-described embodiments may be made without departing from the nature, spirit or scope of the invention, the invention is not to be limited to those details.

I claim:

1. A soft-sided insulated container assembly comprising:

a soft-sided insulated container, a primary lifting member and a secondary lifting member;

said soft-sided insulated container having a front panel, a back panel and a pair of first and second side panels;

said front panel having a predominantly rectangular form, said rectangular form having a pair of first and second generally opposed first and second long sides, and a pair of first and second generally opposed short sides, said first long side being located lower than said second long side;

said primary lifting member being mounted to the pair of first and second side panels;

said primary lifting member, in use, having a center of lift closer to said back panel than to said front panel;

said secondary lifting member being mounted to the front panel by mounting members such that the secondary lifting member is closer to the first long side than it is to the second long side;

said primary lifting member including a load spreading pad for engagement of a user's shoulder; and said secondary lifting member including a bail for grasping engagement by a user's hand;

said primary lifting member has a first end and a second end;

said first end of said primary lifting member is mounted to said first side panel;

said second end of said primary lifting member is mounted to said second side panel;

said primary lifting member is a shoulder strap;

said first end of said primary lifting member has a mount that has a first leg and a second leg, each of said first leg and said second leg is mounted to said first side panel, and each of said first leg and said second leg carries a portion of load of said first end of said primary lifting member, said first and second legs being mounted asymmetrically on said first side panel, and, as mounted, said first end of said primary lifting member being tilted toward said back panel; and said second end of said primary lifting member has a mount that has a first leg and a second leg, each of said first leg and said second leg is mounted to said second side panel, and each of said first leg and said second leg carries a portion of load of said second end of said primary lifting member, said first and second legs being mounted asymmetrically on said second side panel, and, as mounted, said second end of said primary lifting member being tilted toward said back panel.

2. The soft-sided insulated container of claim 1 wherein:

said container has a length, a height and a lateral depth, said length being at least as great as said lateral depth;

said container has a centroid relative to said length, height, and lateral depth;

said height is at least as great as said lateral depth;

said first and second side panels are longitudinally spaced apart;

said front and back panels are spaced apart laterally depthwise;

said first end of said primary lifting member passes loads into said first side panel both laterally inboard and laterally outboard of said centroid, and said second end of said primary lifting member passes loads into said second side panel both laterally inboard and laterally outboard of said centroid.

3. The soft-sided insulated container of claim 1 wherein:

said back panel defines an inboard wall of said container assembly, and said front panel defines an outboard wall of said container assembly, in use said inboard wall being carried next to a user's body, said outboard wall being carried away from the user's body;

said secondary lifting member is a grip having the form of a handle having a bail, said handle being mounted to said outboard wall.

4. The soft-sided insulated container of claim 1 wherein said container has a centroid and said load spreading pad has a lifting location that, in use, is higher than said centroid by a distance greater than said height of said container body.

5. The soft-sided insulated container of claim 1 wherein said second lifting member includes a handle standing outwardly from a face of said container body.

6. The soft-sided insulated container of claim 5 wherein said container has a base panel and front, back, and sidewall panels extend peripherally upwardly therefrom, and said bail is rooted to pull upwardly on said base panel.

7. The soft-sided insulated container of claim 1 wherein said back panel defines an inboard wall of said container assembly, and said front panel defines an outboard wall of said container assembly, in use said inboard wall being carried next to a user's body, said outboard wall being carried away from the user's body; said container has an uppermost panel, said uppermost panel includes a closure member; and said closure member has a hinged laterally inboard edge.

8. The soft-sided insulated container of claim 7 wherein said uppermost panel further includes an auxiliary zipperless access that is smaller than said closure member.

9. The soft-sided insulated container assembly of claim 1 wherein:

said container has a length, a height and a lateral depth;

said container has a centroid relative to said length, height, and lateral depth;

said length being at least as great as said lateral depth;

said container has a soft-sided wall structure including an outer skin, an inner skin and a layer of insulation therebetween;

said container has an insulated chamber defined therewithin, and an externally accessible closure member governing access thereto;

said primary lifting member first and second ends longitudinally bracketing said centroid;

in use, said load spreading pad lying inboard of said container relative to said lateral depth thereof, and at an height higher than said container;

said bail being located longitudinally intermediate said first and second ends of said primary lifting member;

said grip being located outboard of said container body relative to said lateral depth thereof; and said grip being located at a height lower than said centroid.

10. The soft-sided insulated container of claim 9 wherein said bail stands outwardly from said front panel of said container.

11. The soft-sided insulated container of claim 10 wherein said container has a base panel and sidewall panels extending peripherally upwardly therefrom, and said secondary lifting member is rooted to pull upwardly on said base panel.

12. The soft-sided insulated container of claim 9 wherein said container has an uppermost panel, said panel includes said closure member, and said closure member has a hinged laterally inboard edge.

13. The soft-sided insulated container of claim 12 wherein said uppermost panel further includes an auxiliary zipperless access that is smaller than said closure member.

* * * * *